United States Patent [19]

Kuroda et al.

[11] Patent Number: 4,771,313

[45] Date of Patent: Sep. 13, 1988

[54] SERVICE LIFE INDICATOR FOR A PROCESS CARTRIDGE

[75] Inventors: Koki Kuroda, Tokyo; Tsuneki Inuzuka, Machida; Toshiaki Yagasaki, Hino, all of Japan

[73] Assignee: Canon Kabushiki Kaisha, Tokyo, Japan

[21] Appl. No.: 533,439

[22] Filed: Sep. 19, 1983

[30] Foreign Application Priority Data

Sep. 30, 1982 [JP] Japan ..... 57-171922

[51] Int. Cl.[4] ..... G03G 15/00

[52] U.S. Cl. ..... 355/3 R; 355/3 DR; 355/3 DD; 355/14 R; 355/14 D; 355/14 CU

[58] Field of Search ..... 355/3 R, 14 R, 300, 355/14 D, 3 DR, 3 SH, 15, 16, 14 CU; 118/691, 689, 690, 712, 658; 354/295

[56] References Cited

U.S. PATENT DOCUMENTS

| | | | |
|---|---|---|---|
| 3,600,086 | 8/1971 | Cates et al. | 355/16 |
| 3,700,323 | 10/1972 | Guvette et al. | 355/3 R |
| 3,756,711 | 9/1973 | Limberger | 355/50 |
| 3,788,739 | 1/1974 | Coriale | 355/17 |
| 3,872,282 | 3/1975 | Long | 355/14 CU X |
| 3,886,329 | 5/1975 | Kamiyama | 355/14 CU X |
| 3,900,740 | 8/1975 | Akimoto et al. | 355/14 R X |
| 3,926,515 | 12/1975 | Nagahara | 355/3 R |
| 3,985,436 | 10/1976 | Tanaka et al. | 355/8 |
| 4,025,178 | 5/1977 | Yokozawa et al. | 355/3 R |
| 4,032,229 | 6/1977 | Tani et al. | 355/15 |
| 4,076,402 | 2/1978 | Kanno et al. | 355/3 DR |
| 4,084,901 | 4/1978 | Aasen et al. | 355/16 |
| 4,116,556 | 9/1978 | Tanaka et al. | 355/3 SH |
| 4,155,638 | 5/1979 | Blitzer | 355/14 D X |
| 4,203,386 | 5/1980 | Blochl et al. | 355/3 DD X |
| 4,226,525 | 10/1980 | Sakamoto et al. | 355/14 D |
| 4,236,807 | 12/1980 | Kuehnle | 355/3 R |
| 4,239,365 | 12/1980 | Norris | 354/295 |
| 4,241,696 | 12/1980 | Huzii | 355/14 D X |
| 4,261,660 | 4/1981 | Suzuki et al. | 355/14 R |
| 4,286,861 | 9/1981 | Matsumoto et al. | 355/3 R |
| 4,325,626 | 4/1982 | Murata et al. | 355/3 DR |
| 4,327,992 | 5/1982 | Babicz | 355/3 R |
| 4,357,901 | 11/1982 | Fagen, Jr. et al. | 355/3 DR X |
| 4,371,257 | 2/1983 | Nishikawa | 355/14 D |
| 4,386,838 | 7/1983 | Hirabayashi et al. | 355/3 DR |
| 4,405,226 | 9/1983 | Kimura et al. | 355/14 D |
| 4,437,757 | 3/1984 | Komori et al. | 355/15 |
| 4,500,195 | 2/1985 | Hosono | 355/3 R |
| 4,551,000 | 11/1985 | Kanemitsu et al. | 355/3 R |

FOREIGN PATENT DOCUMENTS

| | | | |
|---|---|---|---|
| 58-152263 | 9/1983 | Japan | 355/3 R |

*Primary Examiner*—A. C. Prescott

*Attorney, Agent, or Firm*—Fitzpatrick, Cella, Harper & Scinto

[57] ABSTRACT

A service life indicator for an image forming process cartridge which contains a consumable used for image formation and is detachably mountable into a main assembly for the image formation, comprises a switching device, adapted to be provided in the process cartridge, actuatable in response to consumption of the consumable, and a warning device, responsive to the switching device, for warning an operator of when the service life of the process cartridge has been consumed.

15 Claims, 6 Drawing Sheets

SERVICE LIFE INDICATOR FOR A PROCESS CARTRIDGE

BACKGROUND OF THE INVENTION

1. Field of the Invention

The present invention relates to a service life indicator for a process cartridge which is used for image formation and which contains therein at least one consumable, the process cartridge being detachably mountable into a main assembly or body of the image forming apparatus.

2. Description of the Prior Art

The prior art will be described with respect to an electrophotographic copying apparatus, as an example of the image forming apparatus.

Conventionally, electrophotographic machines require a trained and expert serviceman for replacement of the photosensitive member, which is an image bearing member, supply of the developer, disposal of used developer, cleaning of charging wires, replenishment and adjustment of various parts and so on. It is required that the serviceman go to offices having the electrophotographic machines whenever servicing is necessary. This is disadvantageous both for machine makers and machine users, since the makers have to establish and maintain a servicing network to meet the demand for service, and the users have to wait for the serviceman to arrive and then fix the machine before the restart of the machine operation.

Those problems are relatively less serious in the case of large or middle size copying machines, since the number of such copying machines installed is not so large. However, in the case of machines for personal use, the problem is more serious, since the number of machines which are being used is very large, and also since the degree of use is very diffierent among them. Maintenance will be practically very difficult in those cases.

To remove those disadvantages, it is recently proposed, as disclosed in U.S. Pat. No. 3985436, that various process means, such as the photosensitive member, developing device, cleaning means and charger are all contained in a casing as a unit, and that the unit is replaced with a fresh unit when the service life of the photosensitive member ends, so that all the means contained therein are exchanged simultaneously, thus eliminating the machine servicing operation. This makes it possible for users to replace various elements without resort to an expert serviceman and eliminates the necessity of periodic maintenance.

That is, the replacement of the unit (hereinafter also called "process cartridge") covers the replacement of the worn-out photosensitive member, the supply of the developer, the disposal of used developer, the cleaning of a corona discharging wire stained by the developer, for example, and the cleaning of the developing device.

The problems of users can be solved by this approach, since the various process means requiring periodic and/or occasional servicing operations can be replaced with fresh ones simply by replacement of the process cartridge.

It is possible to prepare various process cartridges having different developing characteristics and different reproducing characteristics, and for a user to keep several on hand and use one depending on the desired characteristics. Therefore, there are more opportunity for taking and keeping the process cartridges out of the machine to use another type cartridge or for some maintenance, during the service life of the process cartridge.

Since supply or replacement of consumables is carried out by servicing operators in conventional devices, the degree of use of the machine is known by the servicing operators by checking the counter or the like provided in the machine. Where, however, plural types of the cartridges are interchanged in use by the users themselves, a counter provided on the side of the main assembly can not give the correct usage for the respective cartridges.

SUMMARY OF THE INVENTION

Accordingly, the principal object of the present invention is to solve the above explained problems by enabling one to know the remaining service life of the process cartridges, thus making it possible to operate the machines under the desired conditions.

According to the present invention, a service life indicator is provided for an image forming process cartridge which contains a consumable used for image formation and detachably mountable into a main assembly for the image formation, comprising switching means, adapted to be provided in the process cartridge, actuatable in response to consumption of the consumable, and means, responsive to the switching means, for warning an operator of a remaining service life of the process cartridge. Because of the features of the present invention, the information relating to the remaining service life of the process cartridges, such as the degree of use, degree of the remaining life or the like, can be given to the operator, so that the operator is surely kept informed of the limit of the use.

These and other objects, features and advantages of the present invention will become more apparent upon a consideration of the following description of the preferred embodiment of the present invention taken in conjunction with the accompanying drawings.

DESCRIPTION OF THE PREFERRED EMBODIMENTS

Preferred embodiments of the present invention will now be described in conjunction with the accompanying drawings. The description will be made with respect to an electrophotographic copying apparatus as an example of the image forming apparatus.

Figure 1:
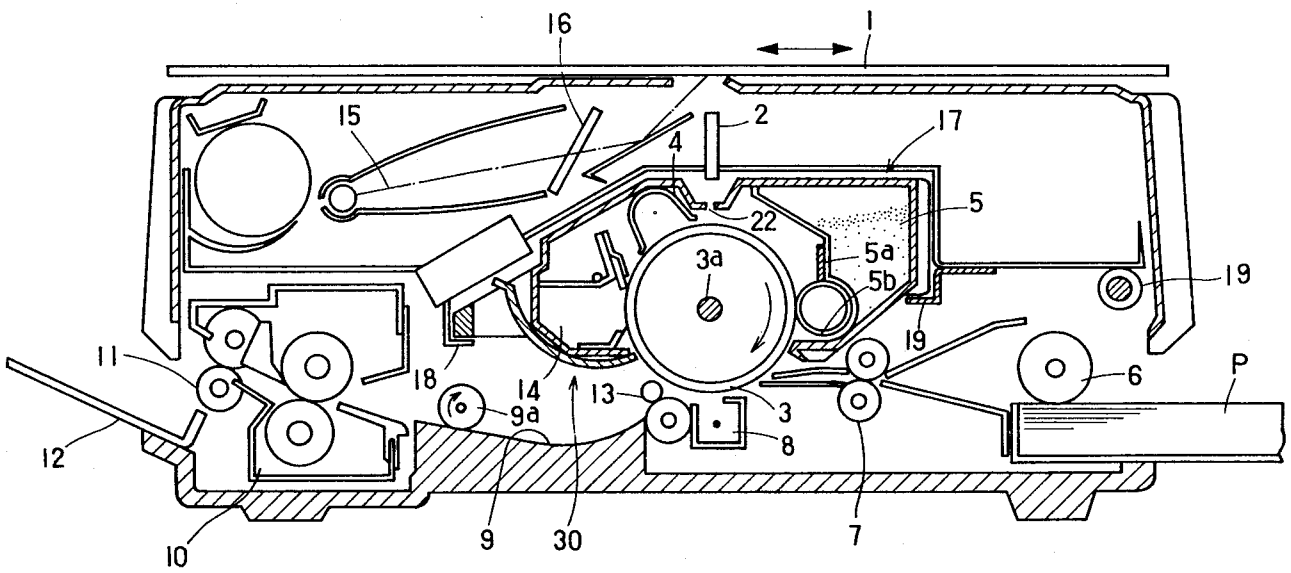
FIG. 1 shows a cross-section of a copying apparatus to which the present invention is applicable.

FIG. 1 illustrates a cross-section of a copying apparatus to which the present invention is applicable. The copying apparatus of FIG. 1 includes a copyboard 1 for carrying an original to be copied, the copyboard 1 being made of a transparent material like glass. The copyboard 1 reciprocates in the directions shown by the arrow. Under the copyboard 1, there is provided an array of image forming elements 2, which is effective to project through a slit 22 an image of the original to be copied placed on the copyboard 1, in a focussed state, onto the surface of photosensitive drum 3 having an organic photoconductor (opc). The original is illuminated by a lamp 15. The photosensitive drum 3 is rotatable about a shaft 3*a* in the direction shown by the arrow. The photosensitive drum 3 is electrically charged by a corona charger 4 which is effective to uniformly charge the photosensitive drum 3. The photosensitive drum 3, which is uniformly charged by the charger 4, is then exposed to the light image through the array 2 to form an electrostatic latent image thereon, which is in turn developed by a developing device, 5, 5*a*, 5*b*.

A transfer sheet P, onto which the thus developed image is to be transferred is fed toward the photosensitive drum 3 by the feeding roller 6 and the register roller 7, and receives the toner image from the photosensitive drum 3 with the aid of the transfer corona charger 8. The transfer sheet P is then separated from the photosensitive drum 3 by the separating means 13 and transported along a guide 9 by a roller 9*a*, which is disposed at a lateral end, to fixing means 10 where the toner image on the transfer sheet P is fixed. The sheet P is then discharged past roller 11 out of the apparatus onto a tray 12.

On the other hand, the toner remaining on the photosensitive drum 3 is removed and collected by the cleaner 14. The apparatus further includes a filter 16 for absorbing infrared or other light and a discharging fan. A shield is fixedly provided to block the light and located at such a position that a process unit, which will be described in detail hereinafter, is slightly spaced apart from the shield.

In this arrangement, the photosensitive drum 3 and the process means therearound such as the developing means 5, cleaning means 14 and the charger 4 and some others are all contained in a shielding wall as a unit, to constitute a process cartridge 17. Because of this arrangement, when one photosensitive drum 3 is replaced with another one, all the process means that are contained in the cartridge are also replaced with new ones. Thus, maintenance servicing is much reduced and simplified. The process cartridge 17 is mounted into or removed from the main body of the copying apparatus by sliding the cartridge 17 along the guiding rails 18 and 19 provided in the main body. Upon this sliding movement, the process cartridge 17 is moved in the direction parallel to the axis of the photosensitive drum 3. The cartridge 17 is taken out of the main body by manually pulling the same along the guide rails 18 and 19, and it is inserted thereinto by manually pushing it along the same guide rails.

Figure 2:
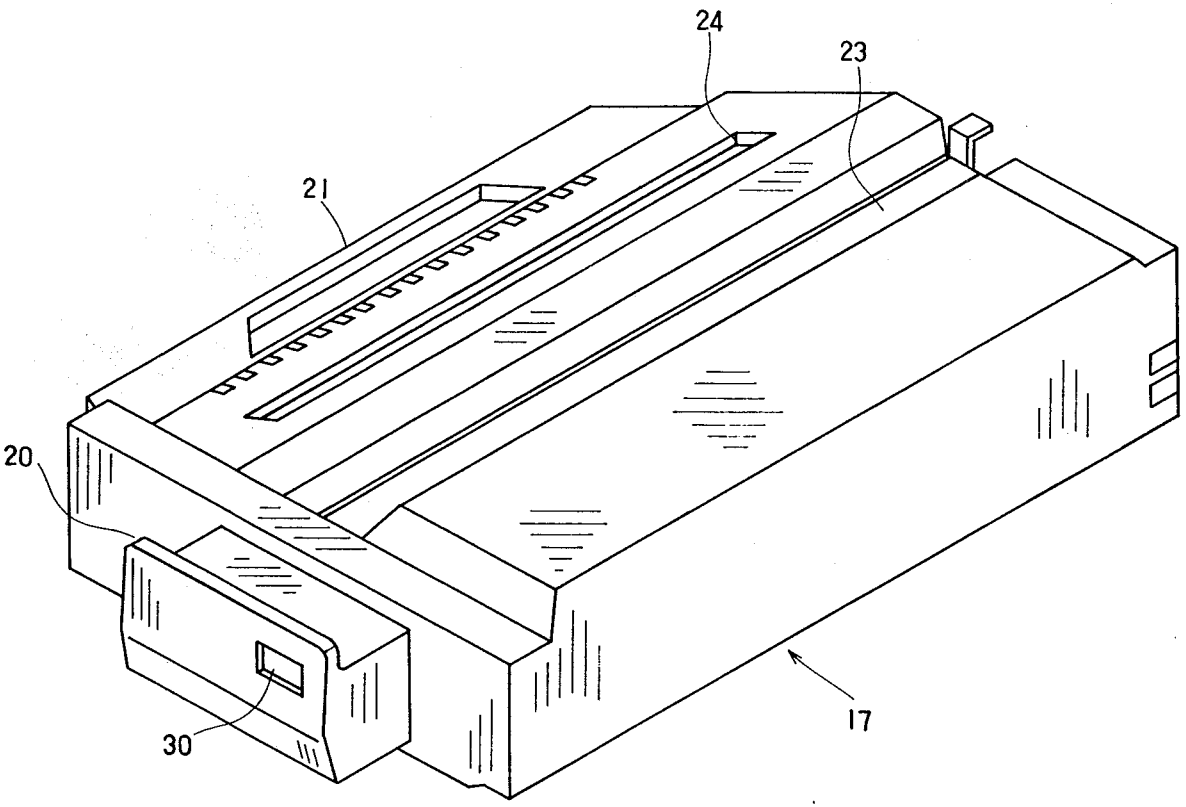
FIG. 2 shows a perspective view, seen from the front, of a process cartridge to which the present invention is applicable.
Figure 3:
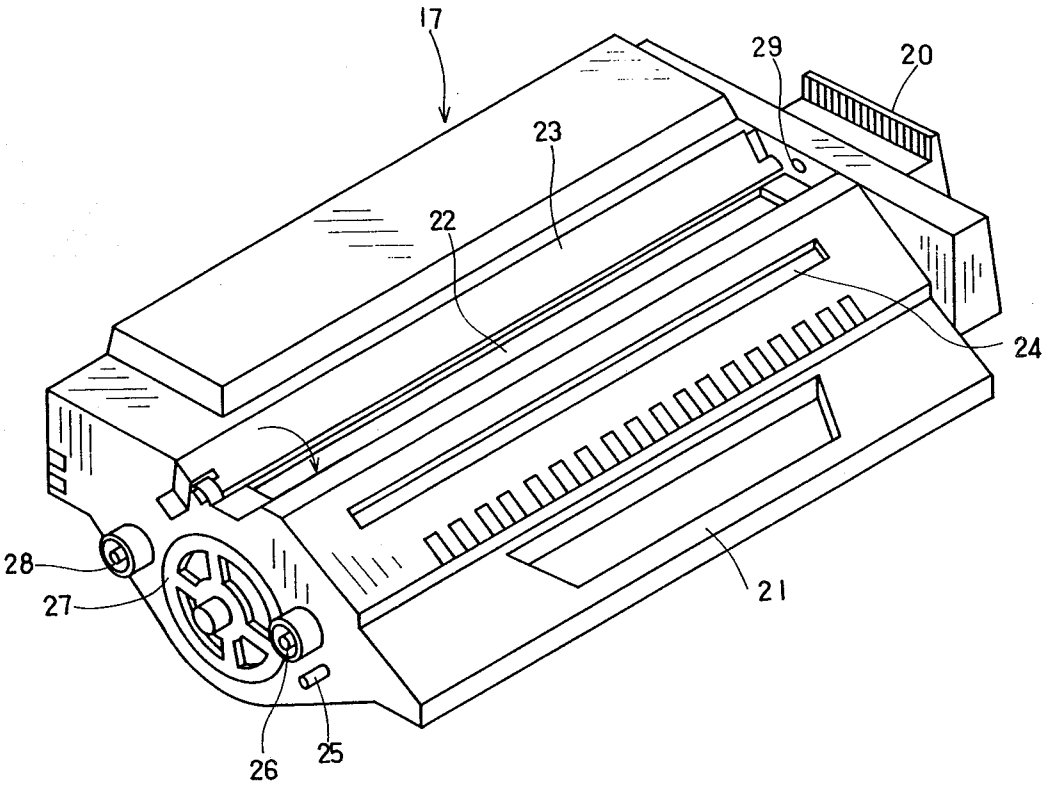
FIG. 3 shows a perspective view, seen from the rear, of the same process cartridge.

FIG. 2 shows a perspective view, seen from the upper front side, of the process cartridge 17 having a device according to an embodiment of the present invention, which has been taken out of the image forming apparatus body. FIG. 3 shows a perspective view of the same seen from the upper rear side. The process cartridge 17 has a grip 20 for pulling the process cartridge 17 out of the image forming apparatus body along the rails and another grip 21 for carrying the process cartridge 17.

The process cartridge 17 has, at its upper portion, a slit 22 for allowing the photosensitive member 3 to be exposed to the image light. The slit 22 can be closed by a shielding plate 23 which is rotatable about a shaft extending along the length of the slit. Further, the cartridge 17 has a slit for the pre-exposure of the drum 3.

As shown in FIG. 3, the process cartridge 17 has at its rear side an indexing pin 25 for mounting itself at a correct position in the image forming apparatus. Also, the process cartridge 17 has at the same side a connector 26 for supplying high voltage power to the corona charger 4 in the process cartridge 17, a gear 27 for transmitting the driving power from the image forming apparatus body to the photosensitive drum 3 of the process cartridge 17 and a connector 28 for applying a bias voltage to the developing means 5, 5*a*, 5*b*. The gear 27 includes projected portions and adjacent recessed portions which are adapted to mesh with the recessed portions and projected portions of a gear, not shown, of the image forming apparatus.

The final positioning of the process cartridge 17 to the main body is effected by an unshown pin of the main body being received by a positioning hole or recess 29 at the other side of the cartridge 17.

Inside the grip 20, there is provided counting means for measuring the degree of use of the cartridge so that the grip functions also as a cover for the counting means. The counting means is driven by the rotation of the photosensitive drum 3. The rotation of the drum 3 is reduced by plural gears, and ultimately drives an indicating gear, which has a green, yellow and red portions. A part of those portions can be seen through an observation aperture 30 (FIG. 2). The green portion being displayed through the aperture 30 means that the cartridge is still usable, while the red portion on display means that the cartridge has been worn out and should be replaced. The aperture 30 is so disposed as to correspond to an opening in the front door, so that the operator looks at the indicator through the opening.

An indicator in the above described embodiment will be described in further detail.

Figure 4:
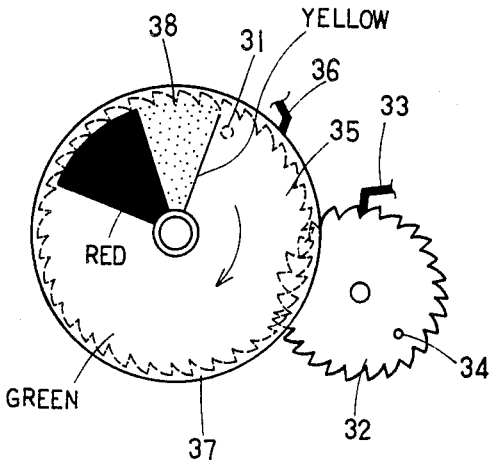
FIG. 4 shows a front view of an embodiment of a counter mechanism according to the present invention.
Figure 5:
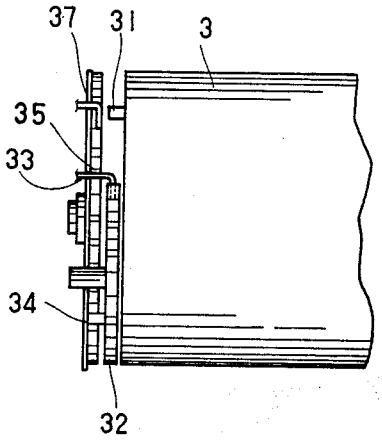
FIG. 5 shows a side view of the counter of FIG. 4.

FIGS. 4 and 5 show the detailed structure of the indicator. FIG. 4 is a front view of the inside of the grip 20, and FIG. 5 is a side view thereof.

As shown in FIG. 5, the photosensitive drum 3 has a pin 31 extending out of one of its longitudinal ends, which pin 31 drives a ratchet wheel 32 by one teeth thereof for each one revolution of the photosensitive drum 3. The rotation of the ratchet wheel 32 is controlled by the leaf spring 33 in its direction and amount of movement. The ratchet wheel 32 has a pin 34 which drives another ratchet wheel 35 by one tooth thereof for each one revolution of the ratchet wheel 32. The rotation of the ratchet wheel 35 is controlled by the leaf spring 36 in its direction and amount of movement. To the ratchet wheel 35, which rotates in the direction shown by the arrow in the manner described above, an indicator disk 37 is fixed so that the ratchet wheel 35 functions as an indicating gear which provides an operator with information relating to the remaining service life of the process cartridge, that is, information representing how much it is used, or representing the remaining lift. The indicator disk 37 has radial colored zones 38 corresponding to the life of the cartridge. The end of the cartridge life is indicated by the red zone, and the zone before the end of the life may be yellow.

The user or operator sees the indicator disk 38 through the aperture 30 and thus knows whether the current cartridge should be replaced or not.

In order to more positively notify the operator, it is possible to use the above counting mechanism as an actuator for an electric switch.

Figure 6:
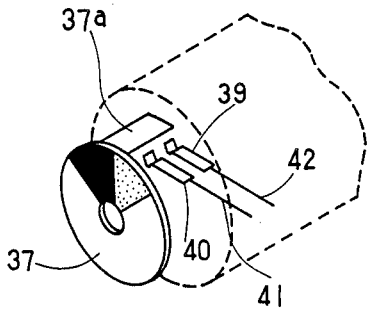
FIG. 6 shows a perspective view of the switch associated with the counter of FIG. 5.

FIG. 6 is a perspective view of the counter used with the switch. In this embodiment, the indicator disk 37 is provided with an integral projection 37*a* which is movable with the indicator disk 37. Along the path of the movement of the projection 37*a*, there are provided contacts 39 and 40 of phosphor bronze fixed to the process cartridge 17. When the projection 37*a* contacts the contacts 39 and 40, those contacts are electrically connected by the projection 37*a*, thus electrically connecting the lead wires 41 and 42.

Figure 7:
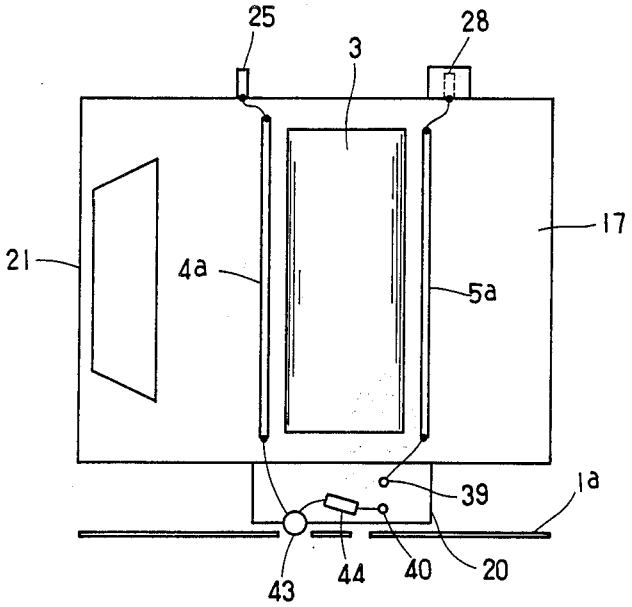
FIG. 7 shows a plan view of a process cartridge incorporating a device according to an embodiment of the present invention.

FIG. 7 shows the indication mechanism used with the FIG. 6 device. The electric connection described above turns on a warning LED 43 by supplying power thereto from the bias voltage which is applied to a magnetic blade 5*a* of the developing device 5. The magnetic blade 5*a* is a member for uniformly coating a sleeve 5*b*, containing therein an unshown magnet, with magnetic developer particles. The blade 5*a* is located at the developer outlet side of the developing device 5 with a small gap from the sleeve 5*b*. The blade 5*a* is disposed codirectionally with the movement of the sleeve 5*b* surface.

Since the bias voltage may be as high as about 1000 V, a current limiting resistor 44 is connected between the LED 43 and the contact 40. The current through the LED 43 flows through a shielding plate 4*a* of the corona discharger 4 and then through the positioning pin 25 of a metal provided on the cartridge 17 to the grounded part of the main body. In this Figure reference numeral 1*a* depicts the front cover of the main body, having an opening through which the indicator disk can be seen and also an opening through which the LED 43 can be seen.

Figure 8:
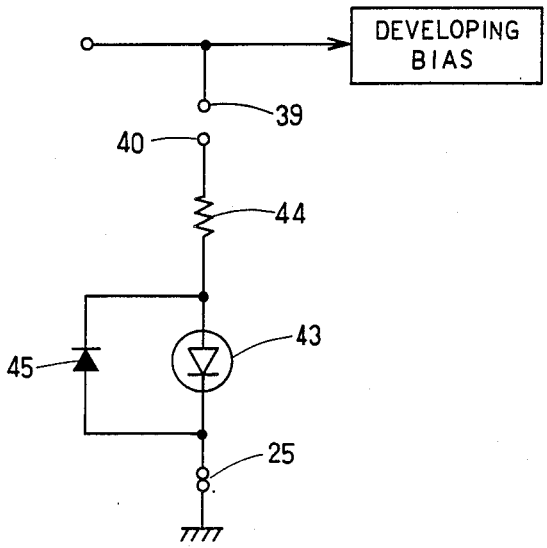
FIG. 8 shows a circuit used in the device of FIG. 7.

FIG. 8 shows a circuit used in FIG. 7 device wherein there is provided a diode 45 for protecting the LED 43 from an inverse bias.

FIG. 7 embodiment can be so modified as to emit a sound signal by replacing LED 43 with a piezo-electric element and replacing the resistor 44 with a capacitance. In this case, the bias voltage applied to the magnetic blade 5*a* is required to be AC. The piezo-electric element emits sound by the voltage applied thereto, thus giving a warning to the operator of the need for replacement of the cartridge. As an alternative, the diode 43 may be replaced by a buzzer.

By the structure of the present invention, it is possible to use an electric warning means without the necessity of any electric power source on the side of the process cartridge 17. Further, by using the shielding plate of the corona discharger as an electric passage, it is possible to flow the current from the front side to the rear side of the cartridge 17, so that the existing element can be used efficiently. As an alternative, it is possible to introduce electric power to the cartridge through another wire which is additionally provided for this purpose, and flow it to the ground through an additional wire or a conductive member.

Figure 9:
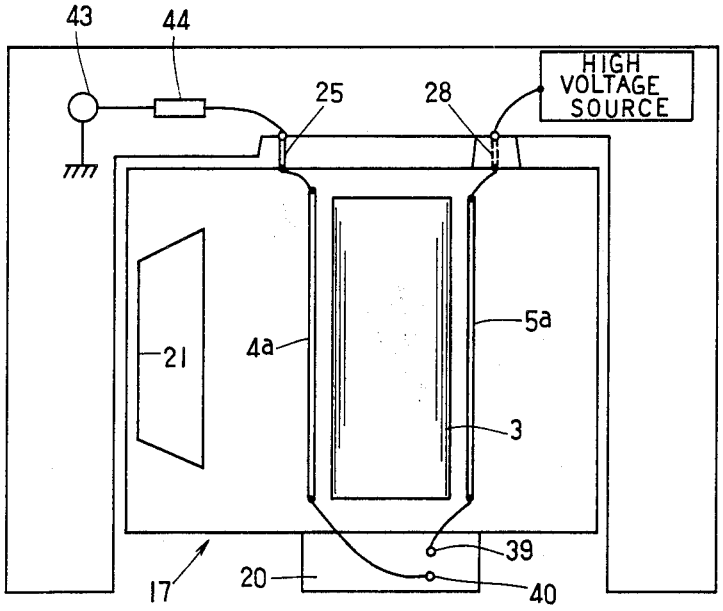
FIG. 9 shows a device according to another embodiment of the present invention.

FIG. 9 shows a modification of an electric warning device, wherein the cartridge 17 has only the indicating disk, and wherein the light emitting element such as LED and/or the sound emitting element such as a piezo-electric element are provided on the side of the main assembly or body. In this embodiment, the indicator provided in the main body can be repeatedly used, and additionally the position of the indicator can be freely selected so that it can be located to effectively warn the operator of the limit of the service life.

Because the indicator is repeatedly usable, that is, the indicator is not disposed of with the process cartridge, it is possible to employ a more expensive element for the indicator and still have a practical device from an economical standpoint. For example, a voice warning with the use of voice generator can be employed economically. For the actuation of the voice generator, the signal from the disk of the counter as described in detail with respect to FIG. 6 may be used.

In the foregoing description, the electric indicator is used together with the color indicator having the disk 37. However, it is a possible alternative for the disk to have only the conductive member for electrically connecting the contacts 43 and 44 and not to have the color plate. In this alternative, the indication is made only electrically. As a driving source for the disk 37, another drive for the cartridge may be used, for example, a stirring device for the developing means, if any.

By electrically actuating a switch with means driven proportionally to the degree of the consumption of the cartridge, a positive indication is made possible, so that correct information can be given to the user. From another aspect of the present invention, the electric power for the process cartridge can be saved, and the number of the parts of the cartridge can be reduced.

As regards the usage of the cartridge, it is not limited to electrophotographic machines, but other types of machines such as facsimile machines, calculator printer or computer printer wherein the photosensitive member may be exposed by LED elements, laser beam or the like, can incorporate such a cartridge.

While the invention has been described with reference to the structures disclosed herein, it is not confined to the details set forth and this application is intended to cover such modifications or changes as may come within the purposes of the improvements or the scope of the following claims.

What is claimed is:

1. In an image forming apparatus, a warning system comprising:

a process cartridge including means responsive to the amount of use of said process cartridge, switch means actuated in response to said responsive means, and means for displaying information relating to the amount of use of said process cartridge;

a main assembly for detachably receiving said process cartridge;

guiding means for guiding said process cartridge when mounting said process cartridge to or removing from said main assembly;

warning means for providing one of an audible and visual warning operable in response to said switch means;

power source means for providing power to said warning means; and means for electrically coupling said power source with said switch means and said warning means.

2. An apparatus according to claim 1, wherein said warning means is provided in said cartridge.

3. An apparatus according to claim 1, wherein said warning means is provided in said main assembly.

4. In an image forming apparatus, a service life indicator comprising:

a process cartridge including means responsive to the amount of service life of said process cartridge, and switch means actuated in response to said responsive means;

a main assembly for detachably receiving said process cartridge;

guiding means for guiding said process cartridge when mounting said process cartridge to or removing from said main assembly;

warning means including one of an audible or visual warning operable in response to said switch means;

power source means for providing power for said warning means; and means for electrically coupling said power source, said switch means and said warning means.

5. An apparatus according to claim 4, wherein said process cartridge includes a blade provided in a developing means.

6. An apparatus according to claim 4, wherein said process cartridge includes a shielding member for a discharger.

7. In an image forming apparatus, a warning indicator comprising:

a process cartridge including means responsive to the amount of use of said process cartridge, switch means actuated in response to said responsive means, and means for displaying information relating to amount of the use of said process cartridge;

a main assembly for detachably receiving said process cartridge;

guiding means for guiding said process cartridge when mounting said process cartridge to or removing from said main assembly;

warning means, provided in said main assembly, including one of an audible and a visual alarm operable in response to said switch means;

power source means for providing power to said warning means; and means for electrically coupling said power source means, said switch means and said warning means.

8. An image forming apparatus, comprising:

a process cartridge including means responsive to the amount of use of said process cartridge, switch means actuated in response to said responsive means, and means for displaying information relating to the amount of use of said process cartridge;

a main assembly for detachably receiving said process cartridge;

guiding means for guiding said process cartridge when mounting said process cartridge to or removing from said main assembly;

warning means, provided in said process cartridge, including one of a visual warning or an audible warning operable in response to said switch means;

power source means for providing power for said warning means; and means for electrically coupling said power source means, said switch means and said warning means.

9. A process cartridge mountable to and removable from a main assembly, comprising as a unit:

an image bearing member;

means for integrally supporting said image bearing member on the main assembly;

detector means responsive to the amount of use of said process cartridge for producing a signal when a predetermined amount of use has occurred;

warning member including one of an audio alarm and a visual alarm responsive to said detector means; and switch means for applying power from the power source to the warning member.

10. A cartridge according to claim 9, wherein the warning means is provided in said cartridge.

11. A cartridge according to claim 9, wherein the warning means is provided in the main assembly and said cartridge includes means for transmitting information regarding the operation of said switch means to the warning means in the main assembly.

12. A process cartridge mountable to and removable from a main assembly, comprising as a unit:

an image bearing member;

means for integrally supporting said image bearing member on the main assembly;

detector means responsive to the amount of use of said process cartridge for producing a use signal;

warning member responsive to said signal from said detector means for producing one of an audible or a visual alarm; and switch means for applying power from the power source to the warning member; and means for displaying the amount of use of said process cartridge on the basis of said detector means.

13. A process cartridge mountable to an removable from a main assembly, comprising as a unit:

an image bearing member;

means for integrally supporting said image bearing member on the main assembly;

detector means responsive to the amount of use of said process cartridge for producing a signal when a predetermined amount of use has occurred;

warning member responsive to said signal; and switch means for applying power from the power source to the warning member; and a conduit part connected with said switch means.

14. A cartridge according to claim 13, wherein said conduit part includes blade member.

15. A cartridge according to claim 13, wherein said conduit part includes a shield member of a charger.

* * * * *

UNITED STATES PATENT AND TRADEMARK OFFICE

CERTIFICATE OF CORRECTION

PATENT NO. : 4,771,313

DATED : September 13, 1988

INVENTOR(S) : KOKI KURODA, ET AL.

It is certified that error appears in the above-identified patent and that said Letters Patent is hereby corrected as shown below:

COLUMN 1

Line 37, "diffierent" should read --different--.
Line 67, "are" should read --is--.

COLUMN 4

Line 9, "slit" should read --slit 24--.
Line 34, "a" should be deleted.
Line 50, "teeth" should read --tooth--.
Line 67, "lift." should read --life.--.

COLUMN 5

Line 3, "indicator disk 38" should read --indicator disk 37--.
Line 44, "FIG. 7" should read --The FIG. 7--.

UNITED STATES PATENT AND TRADEMARK OFFICE

CERTIFICATE OF CORRECTION

PATENT NO. : 4,771,313

DATED : September 13, 1988

INVENTOR(S) : KOKI KURODA, ET AL.

It is certified that error appears in the above-identified patent and that said Letters Patent is hereby corrected as shown below:

COLUMN 8

Line 22, "warning means" should read --warning member--.
Line 24, "warning means" should read --warning member--.
Line 27, "warning means" should read --warning member--.
Line 42, "an" should read --and--.
Line 55, "blade member." should read --a blade member.--.

Signed and Sealed this

Tenth Day of October, 1989

*Attest:*

*Attesting Officer*

DONALD J. QUIGG

*Commissioner of Patents and Trademarks*